United States Patent [19]

Mansbridge et al.

[11] Patent Number: 4,632,296

[45] Date of Patent: Dec. 30, 1986

[54] FORMING OF STIFFENED PANELS

[75] Inventors: Martin H. Mansbridge; John Norton; Paul W. Beazley-Long; David J. Irwin, all of Bristol, England

[73] Assignee: British Aerospace PLC, London, England

[21] Appl. No.: 730,078

[22] Filed: May 3, 1985

[30] Foreign Application Priority Data

May 5, 1984 [GB] United Kingdom ..... 8411611

[51] Int. Cl.[4] ..... B23K 31/00; B23P 11/02

[52] U.S. Cl. ..... 228/157; 228/265; 29/421 R; 29/522 R; 420/902

[58] Field of Search ..... 228/157, 265; 72/342, 72/364; 148/11.5 R; 420/902; 29/421, 421 M, 522

[56] References Cited

U.S. PATENT DOCUMENTS

| | | | |
|---|---|---|---|
| 3,920,175 | 11/1975 | Hamilton et al. | 228/265 |
| 4,043,498 | 8/1977 | Conn, Jr. | 228/265 |
| 4,304,821 | 12/1981 | Hayase et al. | 228/157 |
| 4,351,470 | 9/1982 | Swadling et al. | 228/157 |
| 4,460,657 | 7/1984 | Elrod et al. | 148/11.5 R |
| 4,530,197 | 7/1985 | Rainville | 228/157 |

FOREIGN PATENT DOCUMENTS

| | | | |
|---|---|---|---|
| 1495655 | 12/1977 | United Kingdom | 148R/11.5 R |
| 2030480A | 4/1980 | United Kingdom | 148/11.5 R |
| 2076722A | 12/1981 | United Kingdom | 148/11.5 R |
| 2109711A | 6/1983 | United Kingdom | 148/11.5 R |

*Primary Examiner*—Nicholas P. Godici
*Assistant Examiner*—Samuel M. Heinrich
*Attorney, Agent, or Firm*—Cushman, Darby & Cushman

[57] ABSTRACT

A method of forming a stiffened panel from first and second metal sheets, at least the first sheet being capable of both superplastic deformation and diffusion bonding, and also provided with at least one control region of different thickness compared with other regions of the sheet, includes the steps of:

attaching the sheets together at a series of attachment lines across their faces, the attachment lines and the control region or regions being in predetermined relationship with one another, placing the attached sheets in a mould and heating to within that temperature range within which superplastic deformation and diffusion bonding takes place, urging those areas of the first sheet between the attachment lines away from the second sheet by a common differential pressure at a rate within that range of strain rates at which superplastic deformation occurs to form a series of cavities between the two sheets such that peripheral parts of those areas urged away from the second sheet form side walls of neighboring cavities and become diffusion bonded together to provide internal stiffeners of the finished panel, the control region or regions effecting local modification of the rate of superplastic deformation such that the internal stiffeners adopt a desired configuration and location.

16 Claims, 10 Drawing Figures

FORMING OF STIFFENED PANELS

The invention relates to the forming of stiffened panels by superplastic deformation and diffusion bonding.

Metals having superplastic characteristics have a composition and micro-structure such that when heated to within an appropriate temperature range and when deformed within an appropriate range of strain rate, they exhibit the flow characteristics of a viscous fluid. With such metals, large deformations are possible without fracture.

Diffusion bonding is a process which forms a metallurgical bond by the application of heat and pressure to metals held in close contact for a specific length of time. Bonding is thought to occur by movement of atoms across adjacent faces of the metals to be joined without significantly changing their physical or metallurgical properties. The temperature and pressure ranges at which superplasticity and diffusion bonding occur are found to be generally similar in many cases; the deformation and bonding processes can thus be carried out simultaneously.

The present invention relates to methods of forming stiffened panels generally disclosed in our British Pat. No. 2 030 480. This specification discloses a method in which first and second metal sheets, at least the first sheet being both capable of superplastic deformation and diffusion bonding, are subjected to a panel forming method, including the steps of

- attaching the sheets together at a series of attachment lines across their faces (e.g. by welding),
- placing the attached sheets in a mould and heating to within the temperature ranges within which superplastic deformation and diffusion bonding takes place,
- urging those areas of the first sheet between the attachment lines away from the second sheet by a common differential pressure at a rate within that range of strain rates at which superplastic deformation occurs to form a series of cavities between the two sheets, peripheral parts of those areas urged away from the second sheet forming side walls of neighbouring cavities and becoming diffusion bonded together to provide internal stiffeners of the finished panel.

This method provides stiffened panels of high strength and structural efficiency provided the stiffeners, formed by the bonded sidewalls of adjacent cavities, are regularly spaced and of regular depth. In effect this means that the internal structure of a finished stiffened panel is dictated not by the duties that panel has to perform in use but by the constraints of the forming process. This leads to structural inefficiency since the stiffeners are not necessarily in the most desireable position.

One objective of the present invention is to provide a method of forming a stiffened panel in which the stiffeners can be located precisely where desired.

It is a further objective of the present invention to effect such an objective by using control regions formed in the superplastically deformable sheet to locally modify the rate of deformation as forming takes place.

It is yet a further objective to provide a method in which uniform, but not necessarily constant, forming pressures can continue to be used throughout the panel, thus obviating undesireable complication in the moulding apparatus.

One further objective is to provide a method in which the formed panel has regions of increased metal thickness compared with other regions where stress requirements dictate.

According to the present invention a method of forming a stiffened panel from first and second metal sheets, at least the first sheet being both capable of superplastic deformation and diffusion bonding, and also provided with at least one control region of different thickness compared with other regions of the sheet, includes the steps of:

- attaching the sheets together at a series of attachment lines across their faces, the attachment lines and the control regions or regions being in predetermined relationship with one another,
- placing the attached sheets in a mould and heating to within that temperature range within which superplastic deformation and diffusion bonding takes place,
- urging those areas of the first sheet between the attachment lines away from the second sheet by a common differential pressure at a rate within that range of strain rates at which superplastic deformation occurs to form a series of cavities between the two sheets, peripheral parts of those areas urged away from the second sheet forming side walls of neighbouring cavities and becoming diffusion bonded together to provide internal stiffeners of the finished panel,
- the control region or regions effecting local modification of the rate of superplastic deformation such that the internal stiffeners adopt desired configuration and location.

Some embodiments of stiffened panels formed according to the invention are described by way of example with reference to the accompanying drawings in which.

Figure 4:
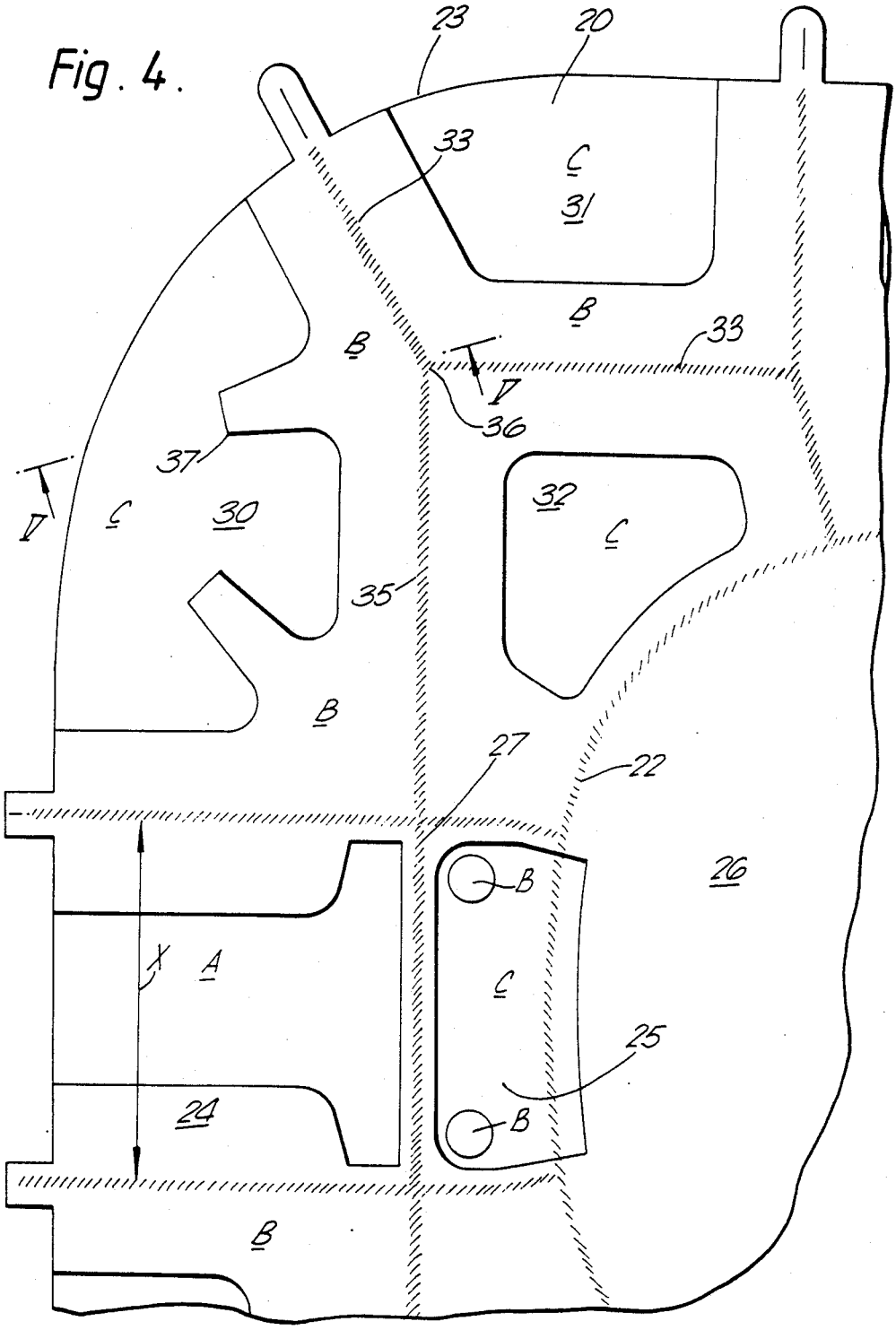
Figure 5:
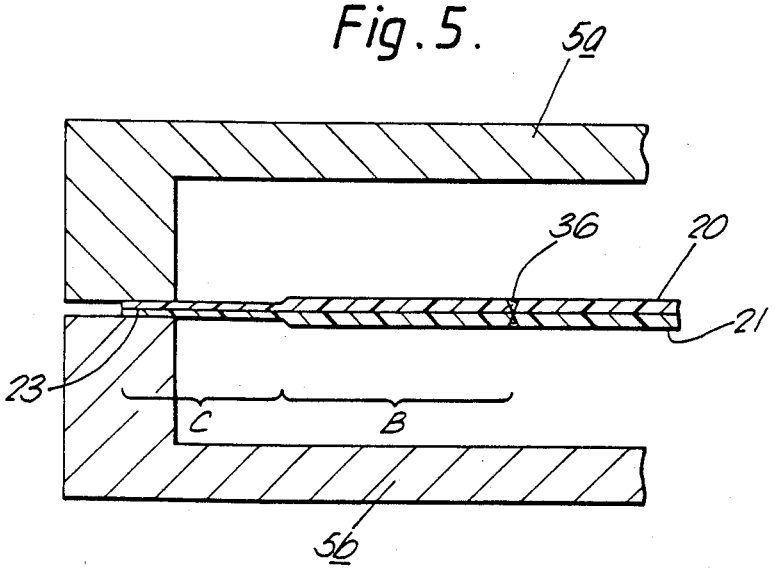
Figure 6:
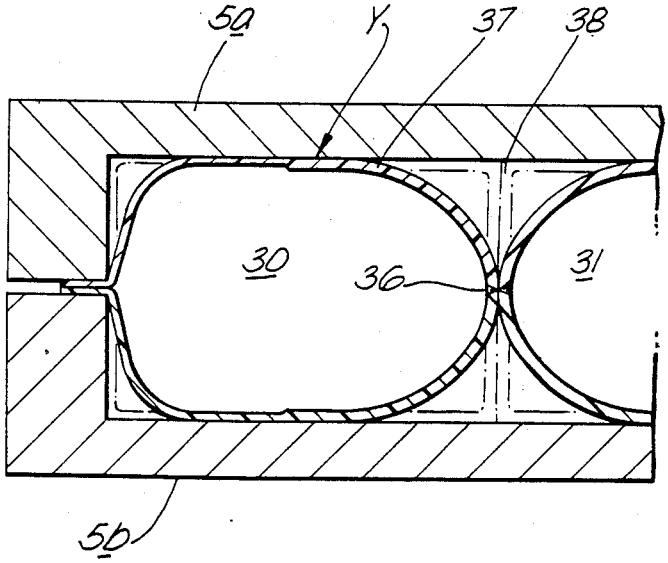
Figure 7:
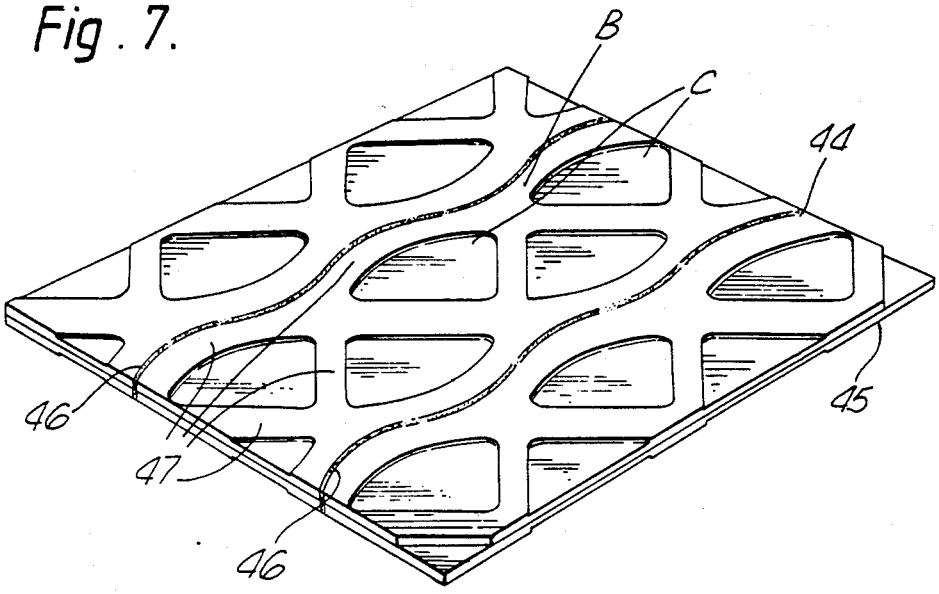
Figure 8:
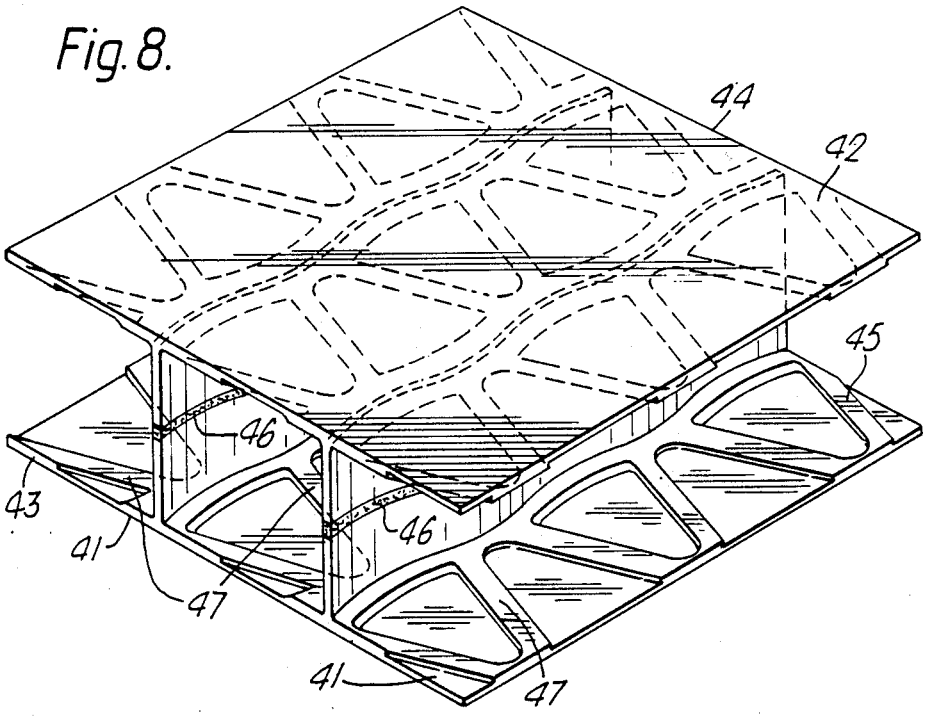
Figure 9:
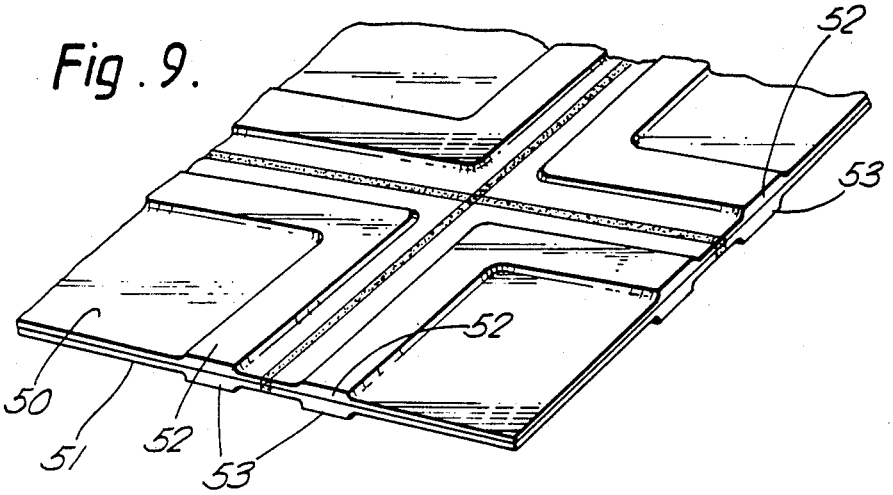
Figure 10:
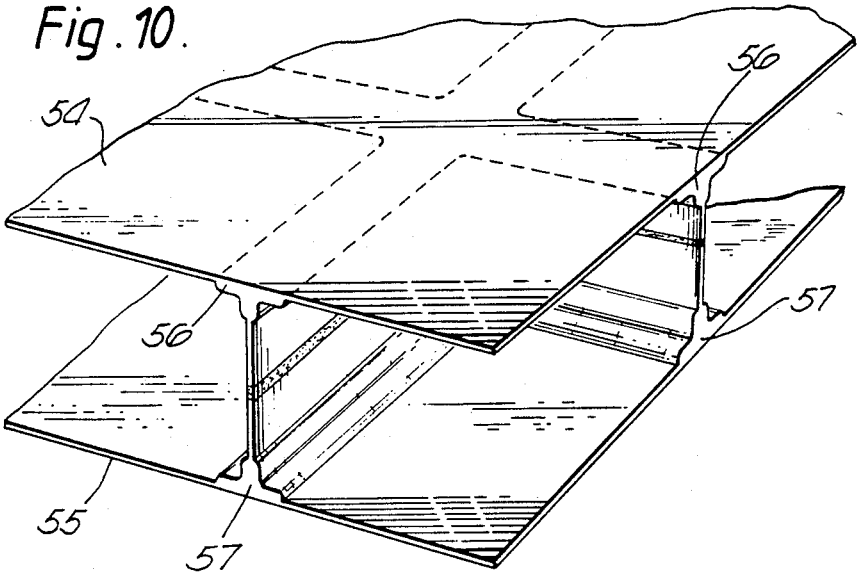
Figure 11:
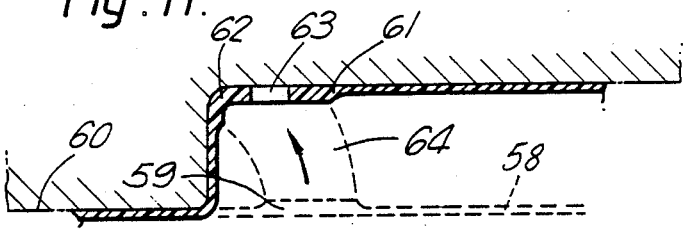

FIG. 4 is a plan view of part of a superplastically deformable and diffusion bondable sheet with non uniformly spaced attachment lines and control regions provided according to the present invention, FIG. 5 is a partly sectioned view of a mould in which two sheets of the type illustrated in FIG. 4 are positioned prior to forming, the section being taken on line V—V of FIG. 4, FIG. 6 is a similar view to that of FIG. 5 but with the sheets in a partially formed condition, shown in full outline and in a fully formed condition shown in broken outline, FIG. 7 is a perspective view of two superplastically deformable and diffusion bondable panels with attachment lines set to provide a wave-like contour of the stiffeners, and with control regions provided according to the invention, FIG. 8 is a similar view to that of FIG. 7 but showing a formed panel, FIG. 9 is a perspective view of two superplastically deformable and diffusion bondable sheets prior to forming and bonding into a panel, the sheets having thickened regions for extra strength, FIG. 10 is a similar view to that of FIG. 9, but with the sheets formed and bonded into a reinforced panel, and, FIG. 11 is a cross-sectional view of a superplastically deformable sheet, both before and after forming, with thickened regions for extra strength.

Figure 1:
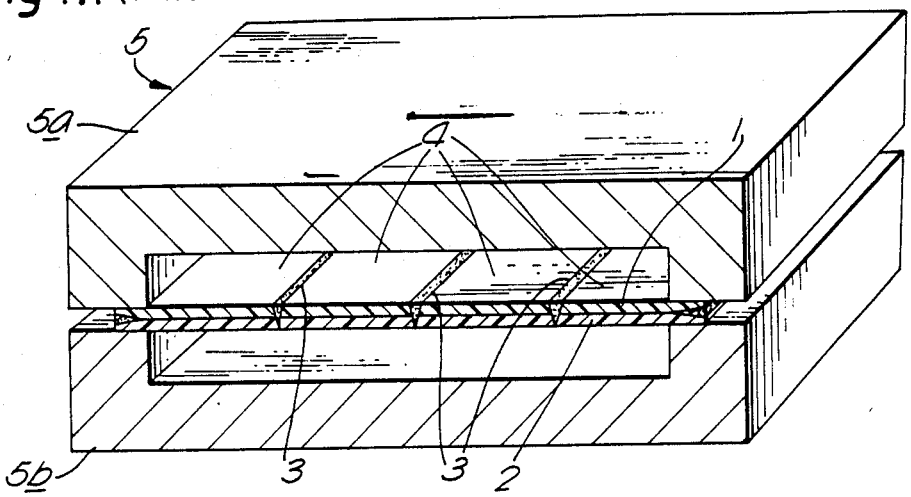
Fig. 1. (PRIOR ART)
FIG. 1 is a partly sectioned perspective view of a mould in which two superplastically deformable and diffusion bondable sheets are positioned prior to forming into a stiffened panel.
Figure 2:
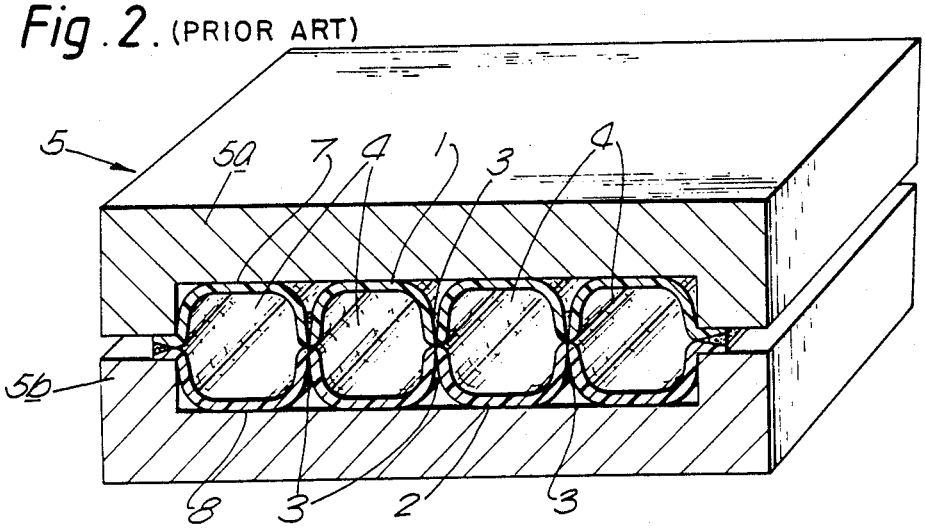
Fig. 2. (PRIOR ART)
FIG. 2 is a similar view during the forming process.
Figure 3:
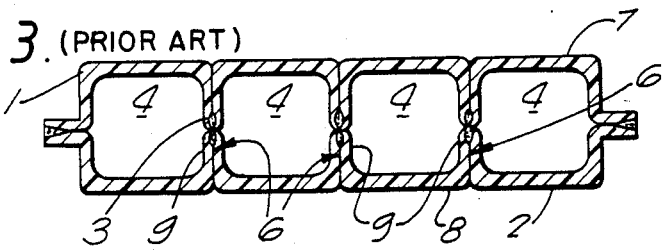
Fig. 3. (PRIOR ART)
FIG. 3 is a cross sectional view of a formed panel.

Referring to FIGS. 1, 2 and 3, a stiffened panel of cellular structure is formed in known manner by sheets 1 and 2. Both sheets have superplastic characteristics and are capable of being diffusion bonded. They are attached to one another by forming continuous or near continuous welds around the edges of the sheets and along several other intersecting lines 3 forming enclosed neighbouring inflatable envelopes 4, the two sheets being clamped between the upper 5*a* and lower 5*b* members respectively of a forming mould 5 in which superplastic deformation and diffusion bonding is to take place. The welding is preferably but not necessarily electron beam welding.

The forming mould 5 and the two sheets 1 and 2 are heated to within a temperature range at which the sheets exhibit superplastic characteristics. An inert gas is admitted under pressure into the envelopes 4 via inlet tubes (not shown). This gradually causes the envelopes 4 to expand in balloon-like fashion, the envelopes thus becoming cavities or cells. Expansion in this form continues until respective metal sheets contact the upper and lower members of the forming mould when the expanding metal, in the region of contact, takes on the flattened shape of the upper and lower mould members, and will eventually form generally continuous upper and lower surfaces 7, 8 respectively of a finished panel as shown in FIG. 3, the overall shape of each cavity becoming sausage-like in transverse cross-section. As pressurised gas is continued to be admitted, the flattened surfaces of the sausage-shape grow to form a generally rectangular shape when neighbouring regions of the cavities forming the walls meet and diffusion bonding occurs, the regions of diffusion bonding being referenced 6. These regions form sidewalls 9 of neighbouring cavities 4. Any one side wall 9 of a cavity extends, as illustrated, between an upper surface 7 and a lower surface 8 of the formed panel with the jointline 3 lying intermediate the two surfaces to form a stiffener.

Where cavities are of different size and/or are of irregular shape, with the known technique described with reference to FIGS. 1–3, it is found that the larger of a pair of cavities forms more quickly which causes malformation of the shared wall regions providing the stiffener; the stiffener tends to migrate towards the smaller of the cavities during forming. Similarly, it is found that where there is intersecting attachment of weld lines, especially where one line terminates at the intersection, malformations can also occur during forming.

A sheet 20 for forming a panel having irregularly shaped cavities, that is to say the finished panel has stiffeners of a specifically desired configuration and location, is illustrated in FIG. 4.

The panel is to be welded to a similar panel 21 along attachment lines 22. Edge regions 23 of the panels are similarly welded to form an envelope after the manner described with reference to FIGS. 1, 2 and 3. A series of irregular cavities are thus provided for inflation as bubbles or sausage shapes by a common gaseous pressure to form stiffeners in the finished panel along the weld lines 23.

That region shown at 26 will not be formed during this process but will be cut away in the completed panel structure to form an aperture or window therein.

Adjacent cavities to be formed are typically illustrated at 24 and 25. That referenced 24 is much larger than that referenced 25; they share a weld line 27. As previously mentioned, during hitherto practiced methods of forming, a stiffener formed along the weld line 27 was found to migrate toward the smaller cavity 25 and accordingly to be both bodily and angularly displaced and otherwise deformed in the finished panel.

Further adjacent cavities to be formed are typically illustrated at 30, 31 and 32. Those referenced 30 and 31 have a common weld line 33, those referenced 31 and 32 have a common weld line 34, whilst those referenced 30 and 32 have a common weld line 35. All three weld lines intersect at 36. This arrangement causes an unequal junction and it is found that the material of the sheet forming the cavity 30 tends to deform during forming towards a temporary channel formed by the presence of the weld line 34.

Naturally, these and other sources of malformation, although described separately for clarity, can and do occur simultaneously in various parts of the panel as forming takes place.

To obviate these malformations the panels 20 and 21, prior to the forming process, are arranged to have control regions of different thickness. Those regions referenced A are of high thickness, those regions referenced B are of intermediate thickness, and those referenced C are of low thickness.

In the sheet illustrated in FIG. 4, where the dimension X is about 4.50 inches, the material of the sheet is a titanium alloy referenced 6 AL 4V with a forming temperature of about 920° C.; before forming the thickness of the regions A is nominally 0.060 inches, that of the regions B is nominally 0.040 inches, and that of the regions C is nominally 0.024 inches.

Referring to the example of cavities 24 and 25, the larger cavity is provided with a region A whilst the smaller cavity is provided with a region C, both regions being surrounded by a region B.

Referring to the example of cavities 30, 31 and 32, all three cavities have regions C at least partly surrounded by a region B. In particular the cavity 30 is provided with a specially shaped region B (shown at 37) extending in elongate form from the intersection 36 generally toward the middle of the cavity.

The prevention of malformation effected by the configuration, shape and location of the control regions A, B, C with reference to the weld lines 22 etc., is thought to occur in the following manner in addition to any modification to the strain rate of superplastic deformation caused by the variations in thickness. Reference is made to FIGS. 5 and 6 which although specifically showing section V—V of FIG. 4 are more-or-less typical of the sort of control effected by the control regions.

In these Figures a panel is to be formed from sheets 20 and 21 in a mould having upper and lower members 5A and 5B similar to that illustrated in FIGS. 1 to 3. In fact, apart from the changes to the sheets, the forming method is the same as that described with reference to those Figures. The sheets are joined around their edges 23 and along weld lines 22, the latter being represented by the intersection 36 by virtue of the chosen sectional elevation.

Cavities 30 and 31 are to be formed without malformation. Thus the sheets have regions of different thickness B and C. Pressurised inert gas is introduced to expand the cavities such that part of region B contacts the interior of the mould. This is shown at Y in FIG. 6; it forms, in effect, an anchorage region since the pressure of the gas holds the sheet tightly against the mould, the friction being such that the sheet cannot slide laterally with respect to the mould as it would if unbalanced stresses were present during forming. The forming of the sheet areas to each side of the region Y are subsequently largely independent, the thinner region C forming more rapidly with a sharp curvature as shown to the left of FIG. 6 and the thicker region B forming more slowly with a more gradual curvature until the final shape, shown in broken outline is reached. The stiffener 38 between the cavities is thus not urged toward the right of the Figure as would otherwise be the case. A similar effect happens in respct of the example of the cavities 24 and 25 in that the extra thickness of region A of the larger cavity ensures that formation of the two cavities occurs at an approximately equal rate and thus prevents migration of the stiffener towards the cavity 25.

Referring now to FIGS. 7 and 8 which illustrate a panel similar to that of FIG. 3, but with corrugated stiffeners 41 formed between the upper and lower surfaces 42 and 43. In this arrangement the sheets 44 and 45 which form the panels are welded together along attachment lines 46 of zig-zag or wave-like formation instead of straight. If formed according to the previous practice outlined with reference to FIGS. 1–3, then the crests of the zig-zag or wave-like form tend to become flattened. In other words, the attachment lines tend to become straightened, causing what is in effect malformation.

To obviate this, the sheets 44, 45 are formed with control regions of thickened material in the regions of the crests of elongate form and extending away from the crests at an angle to one another. The control regions are illustrated at 47. In FIG. 7 they lie on the exterior of the sheets, but in FIG. 8, after forming, the outer surfaces of the sheets are smooth, the control regions having migrated to interior surfaces. Conveniently the control regions 47 extend across a cavity to the crests of a neighbouring attachment line. To use the nomenclature of FIGS. 4 to 6, the control regions 47 may be formed by regions B whilst regions C lie in between the regions B.

Referring now to FIGS. 9, 10 and 11, to effect a particularly efficient structure, those local regions of the formed panel which in use will be subject to stress concentrations and/or which during the forming process will be subject to "thinning", are arranged to have extra material present. In the embodiment of FIGS. 9 and 10, this is arranged by providing the sheets 50, 51 with carefully positioned thickened regions 52, 53 before forming. As shown, they lie parallel to the attachment lines. During the forming process, the material of these thickened regions is redistributed to lie at the 'T'-junctions between the respective surfaces 54, 55 and the stiffeners of the finished panel. The reinforced 'T'-junction regions are shown at 56, 57 respectively.

In FIG. 11, a sheet 58, that is to say a blank, of superplastically deformable metal is provided with a thickened region 59.

Irrespectively, the thickened region 59 is chosen to be of a desired thickness and in such a position that, on completion of forming, its material is where local reinforcement is necessary in the formed panel or article.

In the illustrated embodiment of FIG. 11, the sheet 58 is urged under gaseous pressure, when heated to temperatures at which superplastic forming is possible, into a concave mould (shown generally in broken outline at 60) until it finally reaches the condition shown at 61. In this condition, the thickened region 59 has elongated somewhat, has deformed around a corner 62 which is consequently reinforced, and has provided a reinforcing region for a hole 63 to be later formed. As can be seen, the thickened region 59 has been displaced to protrude from a different side of the sheet during forming. During forming, the approximate path followed by the thickened portion is shown by broken lines 64.

The arrangements of FIGS. 9, 10 and 11 can be used additionally to the arrangement of FIGS. 4 to 8.

In all cases the control and/or thickened regions are preferably provided by a sculpturing process, for example by removing material from a sheet that is originally thicker than required, or by adding material, or by redistributing the material of the sheet. The material removal may be by milling (chemically or otherwise) or by erosion. The material can be added by diffusion bonding or by some other form of anchorage, whilst the material re-distribution may be by rolling or forging.

We claim:

1. A method of forming a stiffened panel having, when formed, spaced upper and lower surfaces and internal stiffeners extending therebetween, at least some of the stiffeners being required to be located at specified, generally irregular positions within the formed panel, the panel being formed from first and second metal sheets, at least the first sheet being capable of both superplastic deformation and diffusion bonding, and also provided with at least one control region of different thickness compared with other regions of the sheet, including the steps of:

attaching the sheets together at a series of attachment lines and the control region or regions being in predetermined relationship with one another, placing the attached sheets in a mould and heating to within that temperature range within which superplastic deformation and diffusion bonding takes place, urging those areas of the first sheet between the attachment lines away from the second sheet by a common differential pressure at a rate within that range of strain rates at which superplastic deformation occurs to form a series of cavities between the two sheets such that peripheral parts of those areas urged away from the second sheet form side walls of neighbouring cavities and become diffusion bonded together to provide internal stiffeners of the finished panel, whereby the selective positioning of said control region or regions tends to equalize any unequal strain rates of superplastic deformation of regions of the first sheet forming adjacent cavities of the series such that the internal stiffeners adopt the specified positions in the formed panel.

2. A method of forming a stiffened panel according to claim 1 in which a portion of a control region is arranged to contact and be held against a mould surface thereby providing an anchorage preventing local sliding movement of a sheet on which the control region is provided with reference to the mould.

3. A method of forming a stiffened panel according to claim 1 in which thickened regions are provided on the first sheet in such a position prior to forming that on forming they provide extra thickness reinforcement of predetermined regions of the cavity walls.

4. A method of forming a stiffened panel according to claim 3 wherein the control and thickened regions are formed on an exterior surface of the first sheet but after forming provide extra thickness on an internal surface thereof.

5. A method of forming a stiffened panel according to claim 1 wherein the attachment lines are not uniformly spaced so that adjacent cavities of different size are formed, and wherein the control regions of greater thickness are provided in those areas of the first sheet between attachment lines defining the larger of the adjacent cavities compared with those areas of the first sheet between attachment lines defining the smaller of the adjacent cavities.

6. A method of forming a stiffened panel according to claim 5 in which a portion of a control region is arranged to contact and be held against a mould surface thereby providing an anchorage preventing local sliding movement of a sheet with reference to the mould.

7. A method of forming a stiffened panel according to claim 5 in which thickened regions are provided on the first sheet in such a position prior to forming that on forming they provide extra thickness reinforcement of predetermined regions of the cavity walls.

8. A method of forming a stiffened panel according to claim 7 wherein the control and thickened regions are formed on an exterior surface of the first sheet but after forming provide extra thickness on an internal surface thereof.

9. A method of forming a stiffened panel according to claim 1 wherein two attachment lines intersect and one terminates at the intersection, to provide two adjacent cavities adjacent a single cavity, and wherein a control region of greater thickness is provided in that area of the first sheet forming said single cavity leading from the intersection compared with areas of the first sheet between attachment lines defining the two adjacent cavities.

10. A method of forming a stiffened panel according to claim 9 in which a portion of a control region is arranged to contact and be held against a mould surface thereby providing an anchorage preventing local sliding movement of a sheet with reference to the mould.

11. A method of forming a stiffened panel according to claim 9 in which thickened regions are provided on the first sheet in such a position prior to forming that on forming they provide extra thickness reinforcement of predetermined regions of the cavity walls.

12. A method of forming a stiffened panel according to claim 11 wherein the control and thickened regions are formed on an exterior surface of the first sheet but after forming provide extra thickness on an internal surface thereof.

13. A method of forming a stiffened panel according to claim 1 wherein the attachment lines are of zig-zag or wave-like form, and wherein a control region is provided in the first sheet extending from each crest of the attachment line.

14. A method of forming a stiffened panel according to claim 13 in which a portion of a control region is arranged to contact and be held against a mould surface thereby providing an anchorage preventing local sliding movement of a sheet with reference to the mould.

15. A method of forming a stiffened panel according to claim 13 in which thickened regions are provided on the first sheet in such a position prior to forming that on forming they provide extra thickness reinforcement of predetermined regions of the cavity walls.

16. A method of forming a stiffened panel according to claim 14 wherein the control and thickened regions are formed on an exterior surface of the first sheet but after forming provide extra thickness on an internal surface thereof.

* * * * *